US006553890B2

(12) United States Patent
Ahn

(10) Patent No.: US 6,553,890 B2
(45) Date of Patent: Apr. 29, 2003

(54) STRUCTURE FOR SUPPORTING A SWASH PLATE AT THE MAXIMUM TILT ANGLE IN A VARIABLE DISPLACEMENT SWASH PLATE TYPE COMPRESSOR

(75) Inventor: Hew Nam Ahn, Taejon-Si (KR)

(73) Assignee: Halla Climate Control Corp., Taejon-si (KR)

( * ) Notice: Subject to any disclaimer, the term of this patent is extended or adjusted under 35 U.S.C. 154(b) by 0 days.

(21) Appl. No.: 09/879,278

(22) Filed: Jun. 12, 2001

(65) Prior Publication Data

US 2001/0049997 A1 Dec. 13, 2001

(30) Foreign Application Priority Data

Jun. 12, 2000 (KR) ..... 2000-32186

(51) Int. Cl.[7] ..... F01B 13/04
(52) U.S. Cl. ..... 92/12.2; 92/71
(58) Field of Search ..... 92/12.2, 71; 417/269

(56) References Cited

U.S. PATENT DOCUMENTS 5,931,079 A 8/1999 Kazahaya ..... 92/12.2
6,116,145 A * 9/2000 Ota et al. ..... 92/71
6,139,282 A * 10/2000 Ota et al. ..... 92/71
6,139,283 A * 10/2000 Ahn ..... 92/71
6,186,048 B1 * 2/2001 Kimura et al. ..... 92/71

FOREIGN PATENT DOCUMENTS

JP 07-158560 6/1995
JP 08-082284 3/1996

* cited by examiner

*Primary Examiner*—Edward K. Look
*Assistant Examiner*—Thomas E. Lazo
(74) *Attorney, Agent, or Firm*—Lowe Hauptman Gilman & Berner, LLP

(57) ABSTRACT

Disclosed herewith is a structure for supporting a swash plate at the maximum tilt angle in a swash plate type compressor. A support projection is formed at a predetermined position of the front surface of the swash plate to define the maximum tilt angle by coming into contact with the rotor of the compressor. When a connecting line passing through the center of a bore, into which a piston in the maximum compression stroke state is inserted, designated by LC, the support projection is situated on an acting line LP, which is spaced apart from the connecting line LC by a predetermined horizontal distance LF in the rotational direction of the swash plate, so as to define the maximum tilt angle of the swash plate.

2 Claims, 9 Drawing Sheets

STRUCTURE FOR SUPPORTING A SWASH PLATE AT THE MAXIMUM TILT ANGLE IN A VARIABLE DISPLACEMENT SWASH PLATE TYPE COMPRESSOR

BACKGROUND OF THE INVENTION

1. Field of the Invention

The present invention relates generally to a structure for supporting a swash plate at the maximum tilt angle in a swash plate type compressor, and more particularly to a structure for supporting a swash plate at the maximum tilt angle in a swash plate type compressor, which is capable of preventing the swash plate from being damaged by eliminating eccentric load caused by differences in the strokes of the pistons.

2. Description of the Prior Art

A compressor constituting one of the principal elements of an air-conditioning apparatus for automobiles is a machine, which selectively receives power from an engine by the intermittence action of a clutch, compresses gaseous refrigerant sucked from an evaporator into its cylinder by the rectilinear reciprocating movement of its piston, and, finally, discharges the refrigerant to a condenser.

Hereinafter, a conventional variable displacement swash plate type compressor is described.

As illustrated in FIGS. 5 to 7, the variable replacement swash plate type compressor comprises a cylinder block 1, in which a plurality of bores 11 are circumferentially arranged and each extended longitudinally. A front housing 3 is positioned in front of the cylinder block 1, and defines a crank chamber 31. A rear housing 4 is positioned behind the cylinder block 1, and defines a suction chamber 41 and a discharge chamber 42. A plurality of pistons 2 are each inserted into a bore 11 of the cylinder block 1 to be moved forward and rearward, and each provided at its rear end with a bridge 21. A drive shaft 6 rotatably passes through the front housing 3, and is rotatably inserted at its rear end into and supported by the center portion of the cylinder 1. A rotor 61 is situated in the interior of the crank chamber 31, and fixedly fitted around and rotates together with the drive shaft 6. A swash plate 7 is fitted around the drive shaft 6 and in the crank chamber 31 to be swung and rotated by support means, such as a bearing or support pin. The swash plate 7 is rotatably supported with its peripheral edge inserted into the bridges 21 of the pistons 2, and hingedly attached at the center portion of the upper portion of its front surface to the rotor 61 to be rotated together with the rotor 61 and to allow its tilt angle to be adjusted with regard to the drive shaft 6. A valve unit 5 is disposed between the cylinder block 1 and the rear housing 4, and functions to suck refrigerant from the suction chamber 41 and to the bores 11 and to discharge compressed refrigerant from the bore 11 to the discharge chamber 42.

A support projection 71, which is brought into contact with the rear surface of the rotor 61 and defines the maximum tilt angle limit of the swash plate 7, is formed on a position of the front surface of the swash plate 7. The tilt angle of the swash plate 7 with regard to the drive shaft 6 is adjusted according to the pressure changes of suction pressure in the rear housing 4 caused by the operation of a control valve 8.

The operation of the swash plate type compressor is described, hereinafter. The pistons 2 arranged in a circle in the cylinder block 1 are sequentially reciprocated by the rotation of the swash plate 7. When a piston 2 moves forward in a bore 11 (that is, during a suction stroke), the suction lead valve of the valve unit 5 is opened by a pressure drop in the bore 11 and the bore 11 communicates with the suction chamber 41, thereby allowing refrigerant to flow from the suction chamber 41 to the bore 11. When a piston 2 moves rearward in a bore 11 (that is, during a compression stroke), the discharge lead valve of the valve unit 5 is opened by a pressure increase in the bore 11 and the bore 11 communicates with the discharge chamber 42, thereby allowing refrigerant to be discharged from the bore 11 to the discharge chamber 42.

In the process of the suction and compression of refrigerant, the swash plate 7 is rotated and the positions of the pistons 2 in their strokes are different, so forces exerted on the swash plate 7 by the pistons 2 are different according to the positions of the swash plate 7 where the pistons 2 are engaged with the swash plate 7. Additionally, as shown in FIG. 9, the support projection 71 defining the maximum tilt angle limit of the swash plate 7 is situated on a connecting line LC passing through the center P1 of the piston 2 in the maximum compression stroke state (that is, the center P1 of the piston 2 at the central position of the upper portion of the swash plate 7, or the center of the bore 11 to which this piston 2 is inserted) and the center P2 of the drive shaft 6 on the front surface of the swash plate 7. However, an acting point P4 of the maximum compression reactive force exerted on the swash plate 7 by the pistons 2 is situated at no a position corresponding to the first point P1 but a position that is spaced apart from the first point P1 by a certain distance L in the rotational direction of the swash plate 7 (see FIG. 8). Accordingly, eccentric load is exerted on the swash plate 7, thereby damaging the swash plate 7 to be bent, deformed or the like. Additionally, when the swash plate 7 is further rotated while being deformed, eccentric wear occurs, thereby creating a loud noise. Additionally, there occurs a problem that the concentration of stress is produced on the hinge unit 64 of the swash plate 7 and the rotor 61.

SUMMARY OF THE INVENTION

Accordingly, the present invention has been made keeping in mind the above problems occurring in the prior art, and an object of the present invention is to provide a structure for supporting a swash plate at the maximum tilt angle in a swash plate type compressor, which is capable of effectively preventing the swash plate from being damaged by preventing eccentric load from acting on the swash plate.

In order to accomplish the above object, the present invention provides a structure for supporting a swash plate at the maximum tilt angle in a swash plate type compressor, in which the swash plate is fitted around a drive shaft by support means to be swung, the peripheral edge of the swash plate is rotatably inserted into the bridges of pistons movably inserted into a plurality of bores formed in a cylinder, the central portion of the upper portion of the front surface of the swash plate is attached by a hinge unit to a rotor fixedly attached around the drive shaft, the center of the hinge unit coincides with the center of the a bore into which a piston at its maximum compression stroke state is inserted, and a support projection is formed at a predetermined position of the front surface of the swash plate to define the maximum tilt angle limit by coming into contact with the rotor, characterized in that: when a connecting line passing through the center of the bore, into which the piston in the maximum compression stroke state is inserted, designated by LC, the support projection is situated on an acting line LP, which is spaced apart from the connecting line LC by a predetermined horizontal distance LF in the rotational direction of the swash plate, so as to define the maximum tilt angle limit of the swash plate.

A diameter of a circle passing through centers of the bores is designated by R, the horizontal distance LF may be in a range of 0.35R to 0.43R.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
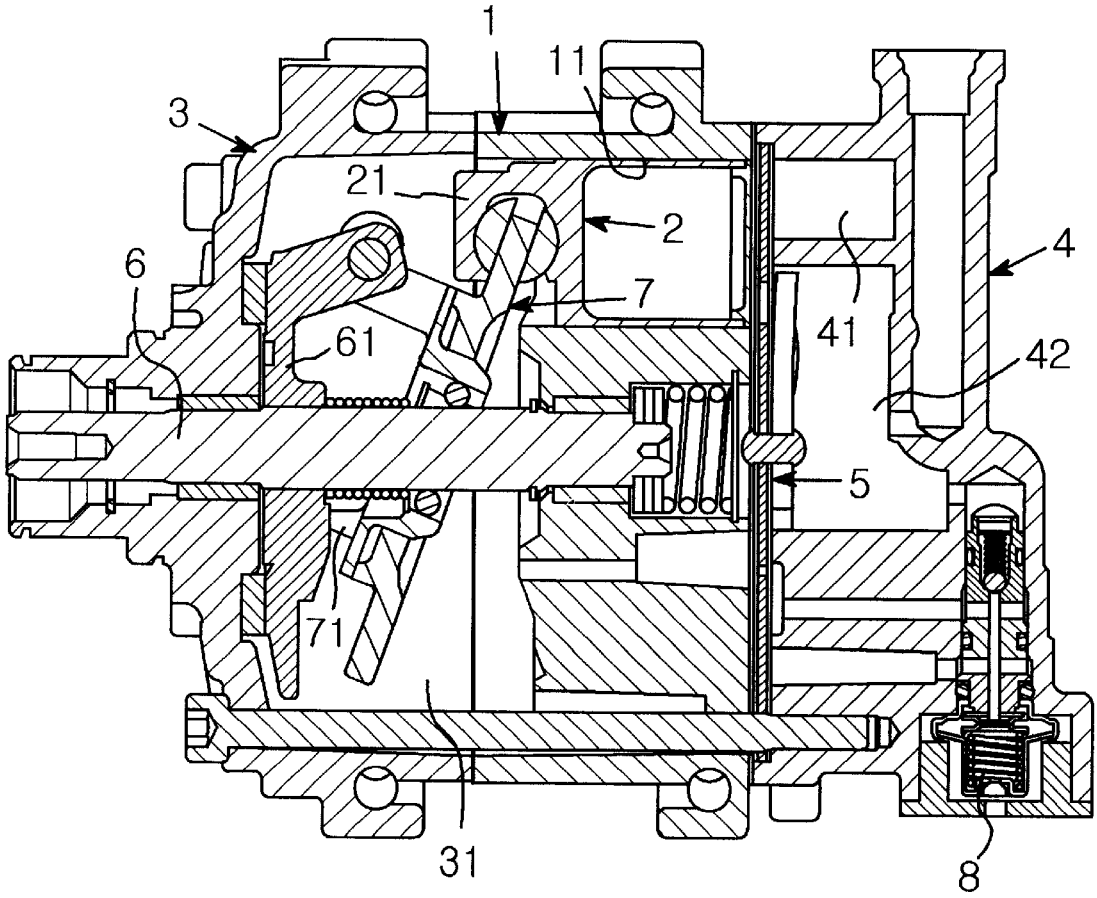
FIG. 1 is a cross section showing a variable displacement swash plate type compressor to which a structure for supporting a swash plate at the maximum tilt angle limit in accordance with the present invention is applied.

Reference now should be made to the drawings, in which the same reference numerals are used throughout the different drawings to designate the same or similar components.

As illustrated in FIG. 1, reference numeral 1 designates the cylinder block of a variable displacement swash plate type compressor. A plurality of bores 11 are circumferentially arranged, and each extended longitudinally to pass through the cylinder block 1 in a longitudinal direction. A plurality of pistons each provided at its front end with a bridge 21 are each inserted into each of bores 11 to be reciprocated. A front housing 3 is attached to the front end of the cylinder block 1, and a rear housing 4 is attached to the rear end of the cylinder block 1. The front housing 3, the cylinder block 1 and the rear housing 4 can be secured to one another by a plurality of bolts 13.

The front surface of the front housing 3 is closed while its rear surface is open, so an interior space defined by the cylinder block 1 and the front housing 3 functions as a crank chamber 31. The front surface of the rear housing 4 is closed while its rear surface is open, so an interior space is formed in the rear housing 4 by the cylinder block 1 and the rear housing 4. The interior space of the rear housing 4 is partitioned into a refrigerant sucking chamber 41 connected to an evaporator and a discharge chamber 42 connected to a condenser. A valve unit 5 is interposed between the cylinder block 1 and the rear housing 4. The valve unit 5 is operated in such a way that during the suction stroke of a piston 2 the refrigerant sucking chamber 41 communicates with a bore 11 to suck refrigerant from the refrigerant sucking chamber 41, while during the compression stroke of the piston 2 the bore 11 communicates with the discharge chamber 42 to discharge compressed refrigerant to the discharge chamber 42.

Reference numeral 6 designates a drive shaft, which penetrates the center portion of the front housing 3, passes through the crank chamber 31 formed in the interior of the front housing 3 and be rotatably supported at its rear end by the center portion of the cylinder block 1. A rotor 61 is fitted around the drive shaft 6 in the front portion of the interior of the crank chamber 31. Accordingly, with the rotation of the drive shaft 6, the rotor 61 is rotated at the same time.

A swash plate 7 is fitted around the drive shaft 6 in the crank chamber 31 to be swung and rotated. The swash plate 7 can be mounted to be swung and rotated by support means, such as a bearing or support pin, interposed between the drive shaft 6 and the swash plate 7.

Figure 2:
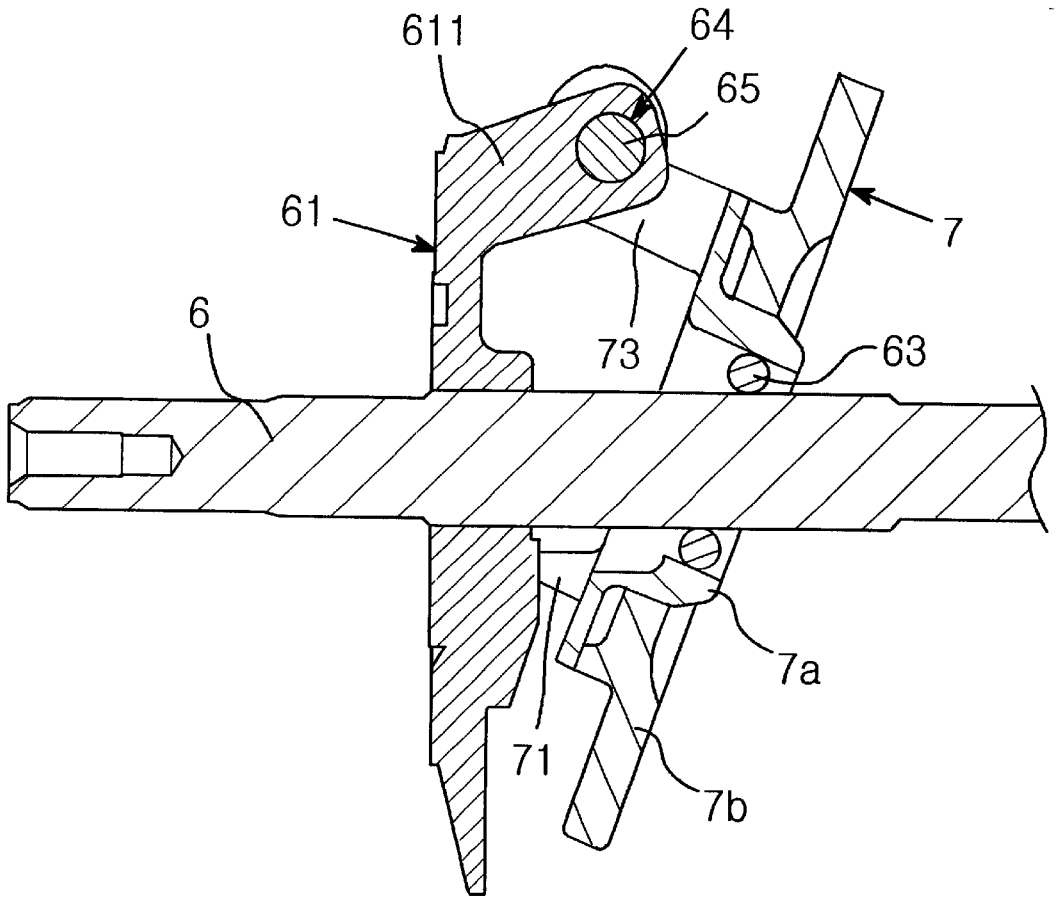
FIG. 2 is a detailed view showing the connection of a drive shaft, a rotor and the swash plate.
Figure 3:
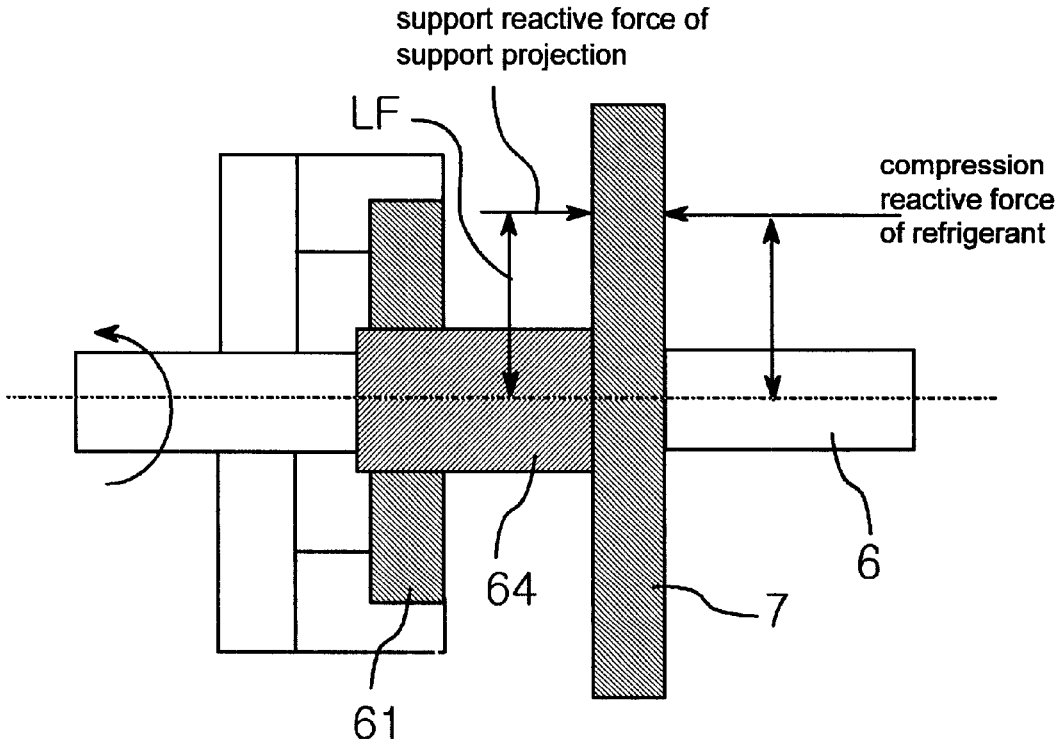
FIG. 3 is a schematic diagram showing the drive shaft, the rotor and the swash plate seen from their top so as to explain the action of forces exerted by the structure of the present invention for supporting the swash plate at the maximum tilt angle.

In more detail, the swash plate 7, as shown in FIGS. 1 and 2, is comprised of a hub plate 7*a* provided with a center hole and mounted around the drive shaft 6 to be swung and rotated by the support means 63, and a drive disk 7*b* integrally and fixedly fitted around the hub plate 7*a*. The peripheral portion of the swash plate 7, that is, the peripheral portion of the drive disk 7*b*, is rotatably inserted into the bridges 21 of the pistons 21. The center portion of the upper portion of the front surface of the swash plate 7 is hingedly connected to the rotor 61. The tilt angle with regard to the drive shaft 6 is preferably adjusted by the swing of the swash plate 7 around a hinge unit 64. In the hinge unit 64, a yoke 73 is formed on the center portion of the upper portion of the front surface of the swash plate 7 (that is, the center portion of the upper portion of the front surface of the hub plate 7*a*), a connecting projection 611 is formed on the central portion of the upper portion of the rear surface of the rotor 61, and the yoke 73 and the connecting projection 611 are hingedly connected to each other by a hinge pin 65.

The swash plate 7 is swung around the hinge unit 64 (that is, the hinge pin 65), so the tilt angle of the swash plate 7 with regard to the drive shaft 6 can be adjusted, and the swash plate 7 can be rotated by the transmission of the rotating force of the rotor 61 to the swash plate 7 through the hinge unit 64.

The tilt adjustment of the swash plate 7 by the swing of the swash plate 7 is performed according to pressure changes in the crank chamber 31, and the pressure changes in the crank chamber 31 are performed by the operation of the control valve 8 mounted on the rear housing 4. That is, the control valve 8 adjusts the amount of refrigerant discharged from a compressor by changing the tilt angle of the swash plate 7 by means of adjusting the pressure of the interior of the crank chamber 31 according to the suction pressure of refrigerant returned to the compressor so as to keep the suction pressure of the compressor constant. As the swash plate 7 is rotated while its tilt angle is adjusted according to the pressure changes, the phase of the swash plate 7 is continuously changed with regard to each piston 2. Accordingly, the pistons 2 are sequentially reciprocated in the bores 11, so the suction and compression of refrigerant is accomplished. The support projection 71, which defines the maximum tilt angle of the swash plate 7 by contact with the rotor 61, is projected from a position of the front surface of the swash plate 7 (in more detail, the front surface of the hub plate 7*a*) toward the rotor 61. In order to allow the support projection 71 to come into surface contact with the rotor 61 while the swash plate 7 maintains its maximum tilt angle, the front surface of the support projection 71 to be brought into contact with the rotor 61, as depicted in FIG. 2, is preferably inclined with regard to the front surface of the swash plate 7 to correspond to the surface of the rotor 61.

Figure 9:
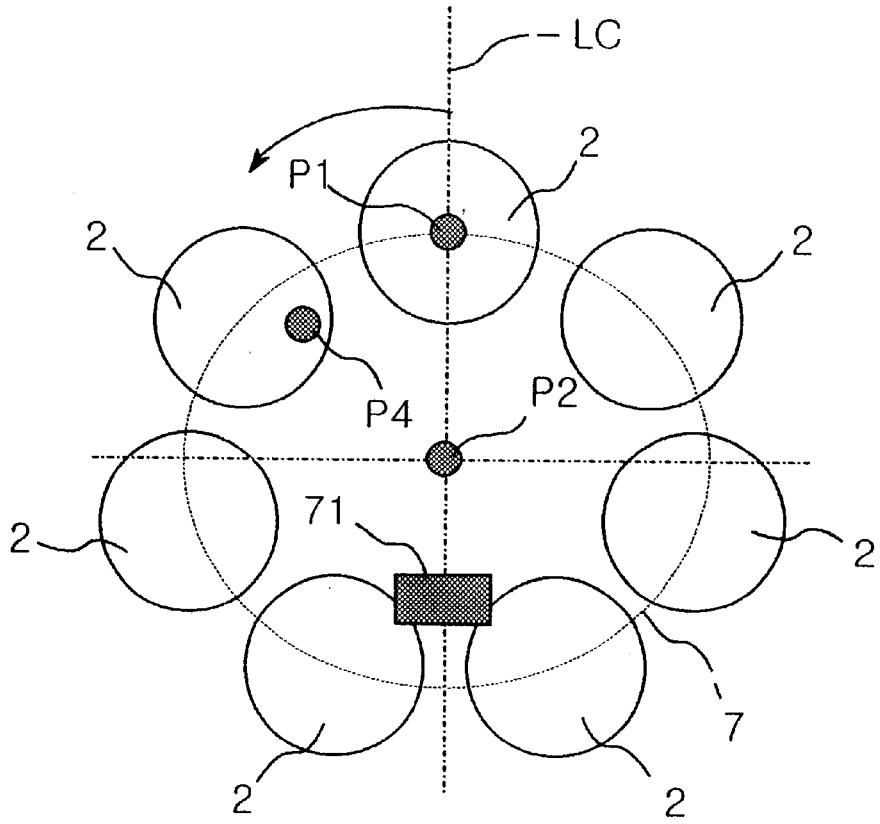
Fig. 9 PRIOR ART
FIG. 9 is a schematic diagram showing piston stroke states, the position of a support projection and the action point of the maximum compression reactive force so as to explain the operation of the conventional structure for supporting the swash plate at the maximum tilt angle.

In the above-described compressor, the swash plate 7 should be swung with regard to the drive shaft 6 around the hinge pin 65 of the hinge unit 64, so a bore 11, into which the piston 2 in its maximum compression stroke state is inserted when the swash plate 7 maintains its maximum tilt angle, should be arranged. Additionally, in such a state, the maximum reactive force exerted on the swash plate 7 by the pistons 2 seems to be situated at a position P1 (first point) corresponding to the center of the bore 11 into which the piston 2 in its maximum compression stroke state is inserted. Accordingly, the support projection 71 for maintaining the maximum tilt angle of the swash plate 7 seems to be situated at an optional position P3(a third point) on a connecting line LC connecting the first point P1 and the center P2 (a second point) on the front surface of the swash plate 7. However, in reality, the swash plate 7 is rotated, and the positions of the pistons 2 in their strokes are different according to the positions where the pistons 2 are engaged with the swash plate 7. Accordingly, forces exerted on the swash plate 7 by the pistons 2 are different according to the positions of the swash plate 7 where the pistons 2 are engaged with the swash plate 7, so an acting point of the maximum reactive force exerted on the swash plate 7 by the pistons 2 is situated on not the first point P1 but a point P4 that is away from the first point P1 in the rotational direction of the swash plate 7 (see arrow in FIG. 9), thereby causing eccentric load to act on the swash plate 7 and, consequently, damaging the swash plate 7 to be bent, deformed or the like. In the structure of the present invention, the support projection 71 is positioned on an acting line LP, which vertically passes through the action point P4 of the maximum reactive force and is spaced apart from the connecting line LC by a distance LF, thereby preventing the maximum reactive force from causing eccentric load to the swash plate 7.

Figure 4:
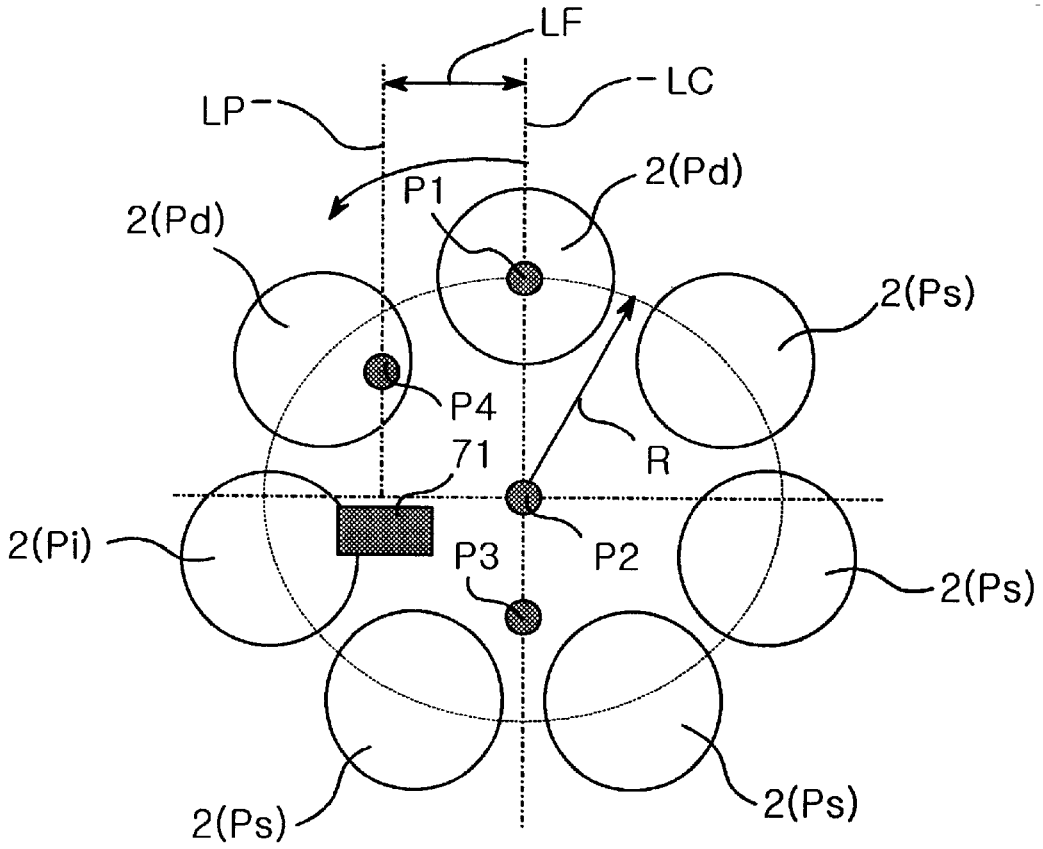
FIG. 4 is a schematic diagram showing piston stroke states, the position of a support projection and the action point of the maximum compression reactive force so as to explain the operation of the structure of the present invention for supporting the swash plate at the maximum tilt angle.
Figure 5:
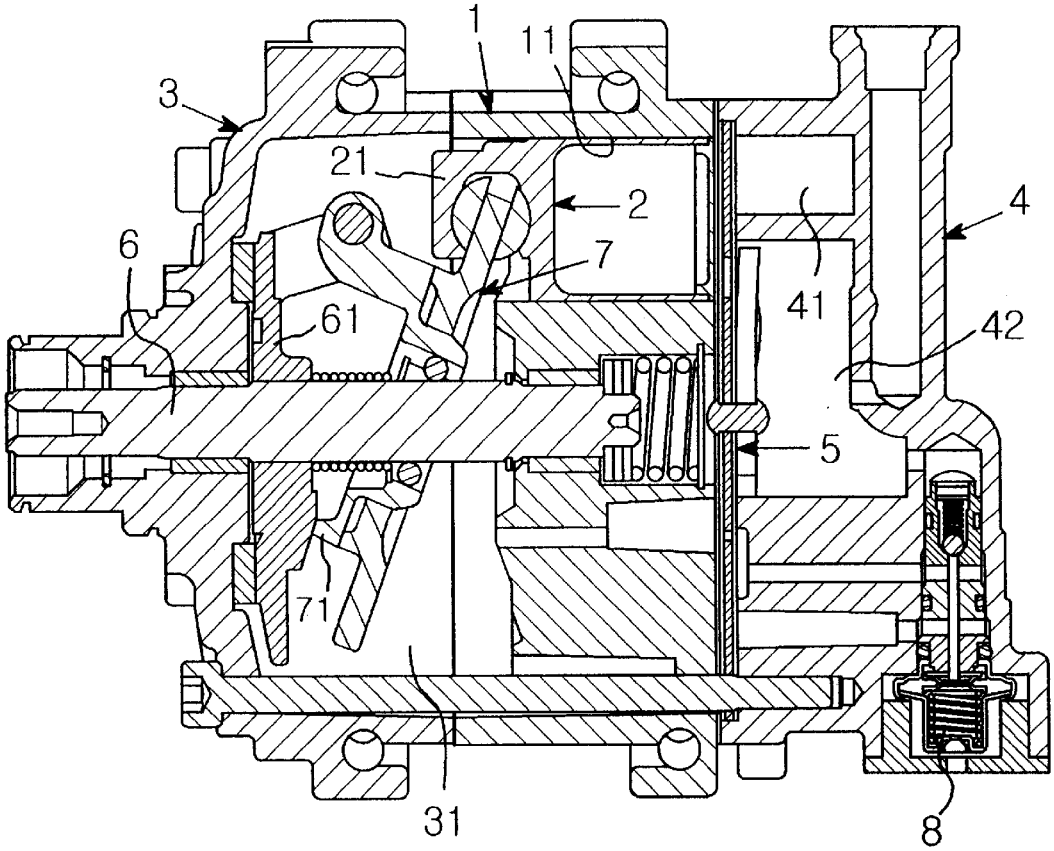
Fig. 5 PRIOR ART
FIG. 5 is a cross section showing a variable displacement swash plate type compressor to which a conventional structure for supporting the swash plate at the maximum tilt angle is applied.
Figure 6:
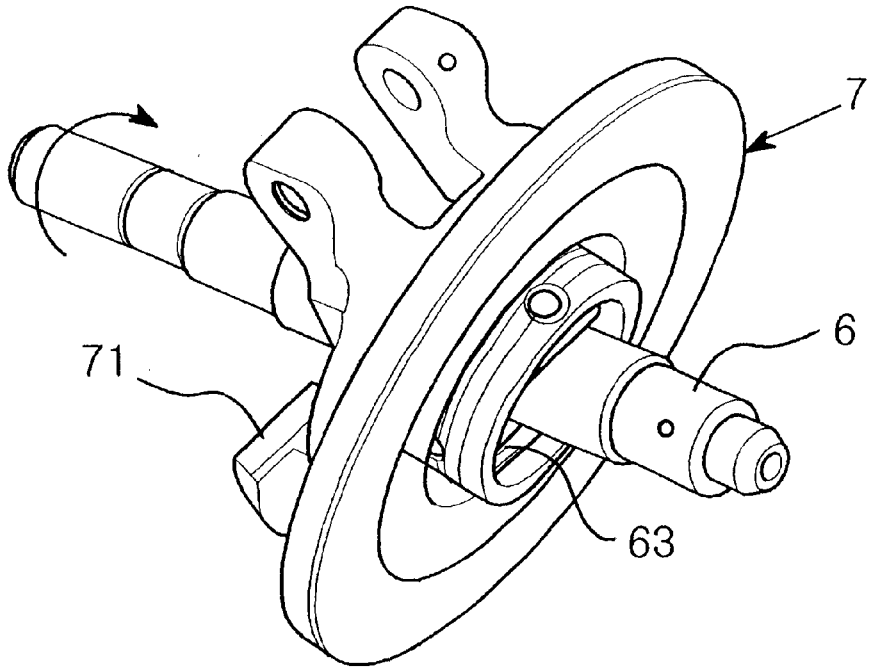
Fig. 6 PRIOR ART
FIG. 6 is a detailed perspective view showing conventional drive shaft and swash plate.
Figure 7:
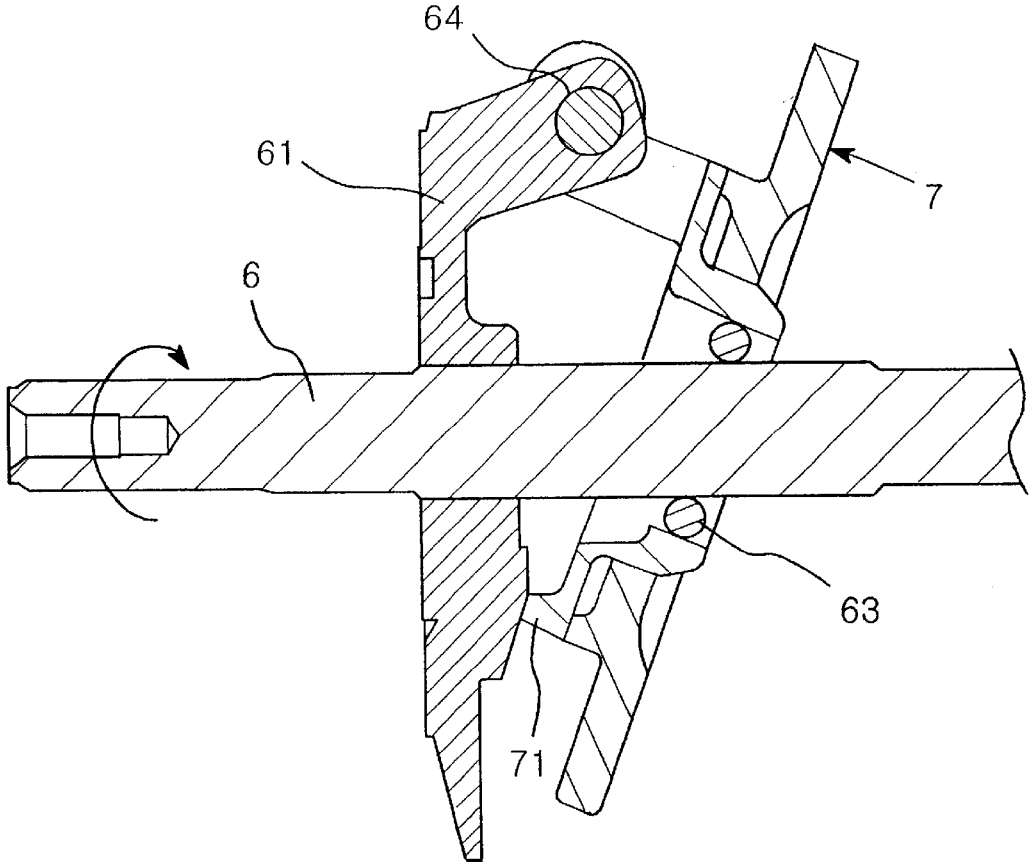
Fig. 7 PRIOR ART
FIG. 7 is a cross section showing the connection of conventional drive shaft, swash plate and rotor.
Figure 8:
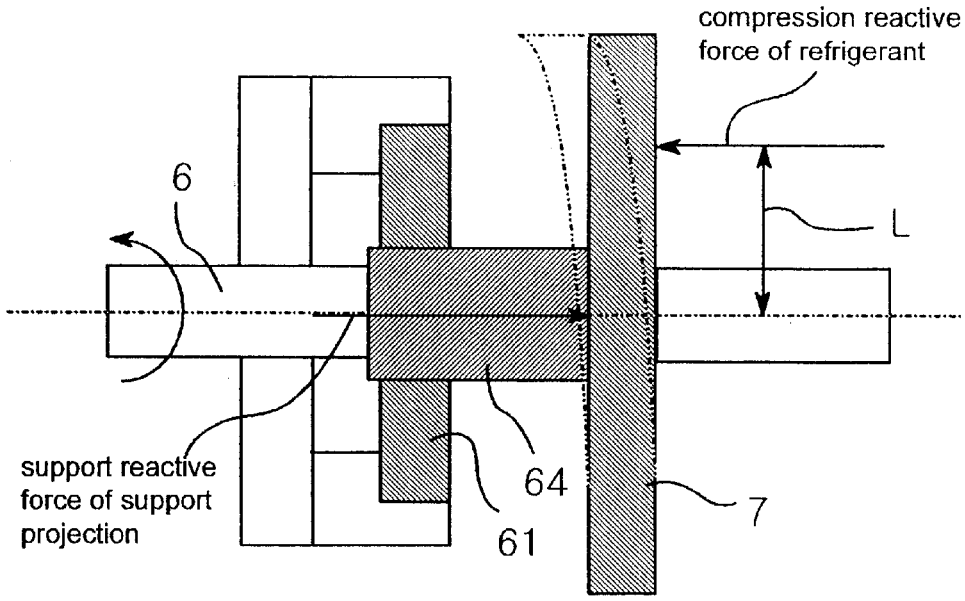
Fig. 8 PRIOR ART
FIG. 8 is a schematic diagram showing the conventional drive shaft, the rotor and the swash plate seen from their top so as to explain the action of forces exerted by the conventional structure for supporting the swash plate at the maximum tilt angle.

As shown in FIG. 4, in this embodiment, the compressor having seven bores 11 is disclosed. The pistons 2 in a compression stroke state are designated by Pd, the pistons 2 in a suction stroke state are designated by Ps, and the pistons 2 in an intermediate state are designated by Pi. Pressure exerted on the swash plate 7 is the largest on the portions of the swash plate 7 corresponding to the pistons Pd in the compression stroke state, intermediate on the portions of the swash plate 7 corresponding to the pistons Pi, and the smallest on the portions of the swash plate 7 corresponding to the pistons Ps.

When the diameter of the circle that passes through the centers of the bores 11 is designated by R, the action point P4 of the maximum reactive force is situated on the acting line LP that is spaced apart from the connecting line LC by the horizontal distance LF of 0.35R to 0.43R in the rotating direction of the swash plate 7. Accordingly, in the structure of the present invention, the support projection 71 defines the maximum tilt angle of the swash plate 7 while being situated on the acting line LP that is spaced apart from the connecting line LC by the horizontal distance LF of 0.35R to 0.43R in the rotating direction of the swash plate 7. The further the support projection 71 is spaced from the center of the drive shaft 6, the better the support projection 71 functions. Accordingly, the support projection 71 may be positioned at an optional position where the horizontal distance LF away from the connecting line LC satisfies a relation of LF□ 0.35R xAs described above, the support projection 71 is not formed on the connecting line LC connecting three points P1, P2 and P3, but formed on the acting line LP that is spaced apart from the connecting line LC by the horizontal distance LF. As a result, the action point of the maximum reactive force and the position of the support projection 71 are opposite to each other on both sides of the swash plate 7, so eccentric load is not exerted on the swash plate 7, thereby preventing the swash plate 7 from being damaged as being bent, deformed or the like.

As described above, the present invention provides a structure for supporting a swash plate at the maximum tilt angle in a swash plate type compressor, in which a support projection 71 and the acting point P3 of the maximum reactive force are situated on the acting line LP spaced apart from the connecting line LC, so the maximum compression reactive force of refrigerant and the support reactive force of the support projection 71 are opposite. Accordingly, eccentric load is not exerted on the swash plate 7, so the swash plate 7 can be prevented from being damaged as being bent or deformed.

When pressure distribution is uniform over the swash plate 7, the concentration of stress created on the hinge unit 64 connecting the rotor 7 and the swash plate 7 can be suppressed, thereby improving the durability of the compressor.

In addition, when pressure distribution is uniform over the swash plate 7, the swash plate 7 can be quietly rotated, thereby reducing the noise of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A structure for supporting a swash plate at the maximum tilt angle in a swash plate type compressor, in which the swash plate is fitted around a drive shaft by support means to be swung, the peripheral edge of the swash plate is rotatably inserted into the bridges of pistons movably inserted into a plurality of bores formed in a cylinder, the central portion of the upper portion of the front surface of the swash plate is attached by a hinge unit to a rotor fixedly attached around the drive shaft, the center of the hinge unit coincides with the center of the bore into which a piston at its maximum compression stroke state is inserted, and a support projection is formed at a predetermined position of the front surface of the swash plate to define the maximum tilt angle by coming into contact with the rotor, wherein:

when a connecting line (LC) passes through the center of the bore, into which the piston in the maximum compression stroke state is inserted, wherein the connecting line (LC) also passes through the center point of an imaginary circle that is formed by connecting the center points of the plurality of bores, the support projection is situated on an acting line (LP), which is spaced apart from the connecting line (LC) by a predetermined horizontal distance (LF) in the rotational direction of the swash plate, so as to define the position of the maximum tilt angle limit of the swash plate, and wherein the support projection is a single projection.

2. The structure according to claim 1, wherein when the radius of the imaginary circle is designated by R, the horizontal distance (LF) is in a range of 0.35R to 0.43R.

* * * * *